US006637140B2

(12) United States Patent
Brandl

(10) Patent No.: US 6,637,140 B2
(45) Date of Patent: Oct. 28, 2003

(54) REVOLVER

(75) Inventor: Rudolf Brandl, Dornhan-Weiden (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 10/124,467

(22) Filed: Apr. 17, 2002

(65) Prior Publication Data

US 2002/0166277 A1 Nov. 14, 2002

Related U.S. Application Data

(63) Continuation of application No. PCT/EP00/10514, filed on Oct. 25, 2000.

(30) Foreign Application Priority Data

Oct. 29, 1999 (DE) ..... 299 19 092 U

(51) Int. Cl.[7] ..... F41C 3/14
(52) U.S. Cl. ..... 42/63
(58) Field of Search ..... 42/63

(56) References Cited

U.S. PATENT DOCUMENTS

| | | | | | |
|---|---|---|---|---|---|
| 57,864 | A | * | 9/1866 | Christ | 42/63 |
| 114,653 | A | * | 5/1871 | Dodge | 42/63 |
| 522,472 | A | * | 7/1894 | Lamm | 42/63 |
| 530,759 | A | * | 12/1894 | Foehl | 42/63 |
| 684,150 | A | * | 10/1901 | Wesson | 42/63 |
| 855,793 | A | * | 6/1907 | Leach | 42/63 |
| 2,101,148 | A | | 12/1937 | Manville | 42/5 |
| 2,150,914 | A | | 3/1939 | Gaidos | 42/77 |
| 4,156,981 | A | * | 6/1979 | Lusk | 42/63 |
| 4,918,850 | A | * | 4/1990 | Rick | 42/59 |

FOREIGN PATENT DOCUMENTS

| | | | |
|---|---|---|---|
| DE | 213 107 C | | 9/1908 |
| EP | 0 833 121 A3 | | 4/1998 |
| EP | 0 833 121 A2 | | 4/1998 |
| FR | 440496 | * | 7/1912 |
| GB | 2662 | * | 9/1872 |
| GB | 2179429 | * | 3/1987 |

OTHER PUBLICATIONS

*International Preliminary Examination Report* (with English–Language translation) corresponding to International patent application Ser. No. PCT/EP00/10514, European Patent Office, Dated Sep. 14, 2001, 4 pages.
*International Search Report* corresponding to International patent application Ser. No. PCT/EP00/10514, European Patent Office, Dated Mar. 2, 2001, 2 pages.

* cited by examiner

*Primary Examiner*—Michael J. Carone
*Assistant Examiner*—Denise J Buckley
(74) *Attorney, Agent, or Firm*—Grossman & Flight, LLC

(57) ABSTRACT

A firearm and an assembly for use in the same are disclosed. The assembly comprises a cylinder having a longitudinal axis. The cylinder defines a plurality of bullet wells and is structured to rotate around the longitudinal axis in response to a shot. The assembly also includes an impact base positioned behind the cylinder to support bullets within the bullet wells. The impact base is rotatable about the longitudinal axis with the cylinder in response to the shot.

12 Claims, 7 Drawing Sheets

REVOLVER

RELATED APPLICATION

This patent arises from a continuing application which claims priority under 35 U.S.C. §120 from International Patent Application No. PCT/EP00/10514, filed Oct. 25, 2000.

FIELD OF THE INVENTION

The invention relates generally to firearms, and more particularly, to a revolver comprising: (1) a cylinder that rotates a distance about its longitudinal axis in response to a shot, and (2) an impact base that supports the bullets in the cylinder from behind.

BACKGROUND OF THE INVENTION

As used herein, "revolver" refers to a firearm having a cylinder that rotates to align a cartridge with the barrel for firing. The term "revolver" includes pistols and rifles that include such a cylinder.

During rotation of the cylinder of prior art firearms, the bullet bases of the bullet shells glide along the impact base. For this reason, the impact base must be smooth, clean, and free of obstructions. The weapon becomes unusable if the material from a breaking ignition capsule penetrates into the bore of the striking pin. Such cases, however, are very rare. The penetration of sand into the weapon is more common. If a small grain of sand becomes lodged between the impact base (sometimes referred to as a recoil plate) and the bullet base when a shot is fired, it presses into the materials and obstructs the rotation of the cylinder. In this case, the marksman's hand must grip the cylinder and support its rotation.

If the weapon is a big game rifle, the reliability with which a second shot is made is of vital importance. The same applies to a weapon used for purposes of defense.

In modem cylinder revolvers, the cylinder usually swings out to the side. This is disadvantageous because, when the cylinder swings out, the empty bullet shells must glide along the impact base, which, in the case of a damaged impact base, sand in the weapon, or problems such as a torn capsule of the type described above, causes problems.

To avoid such problems, one can provide that, when the weapon is opened, the cylinder lifts itself away from the impact base in its first movement, as is, for example, the case with a drop barrel revolver, or in antique revolvers, in which the cylinder moved axially away from the impact base.

Problems of the type mentioned above rarely occur in revolver bullets, which are relatively weak. For this reason, and for reasons of cost and weight, revolvers are now usually made with rigid frames in which the cylinder remains in place (the bullet shells are ejected individually and chamber by chamber) or in which the cylinder can swing out to the side.

By contrast, the bullet shell of a powerful bullet undergoes considerable plastic deformation in the bullet case. The bullet shell deforms to such an extent that it is pressed against the walls of the bullet case. The fired bullet shell is then considerably pre-stressed when it comes to rest against the impact base. If this occurs in a revolver weapon, the elongated bullet shells can significantly impede the rotation of the cylinder. The problems described initially are, thus, intensified in this context.

A revolver is known in which the problems described above do not occur or are substantially diminished (i.e., Russian military revolver, Nagant model). To provide a seal against gas, a block forming the impact base pushes against the cylinder immediately following each shot and presses the cylinder forward. Before the cylinder can rotate further after the shot, the block is removed, thus permitting unobstructed rotation of the cylinder, as it is only the force of a spring that presses it against a rear cover plate. However, this design is complicated and not as well suited for high bullet power.

Otherwise, the impact base along which the fired bullet shells scrape is simply finely planed or polished. This is usually sufficient for small firearm bullets unless, for example, sand becomes lodged between the impact base and the bullet base. However, in a revolver gun that fires a modem high-powered hunting bullet, even larger-grained dust particles becoming lodged between the bullet base and the impact base is sufficient to impede or even prevent the rotation of the cylinder.

DESCRIPTION OF THE PREFERRED EXAMPLES

Figure 1:
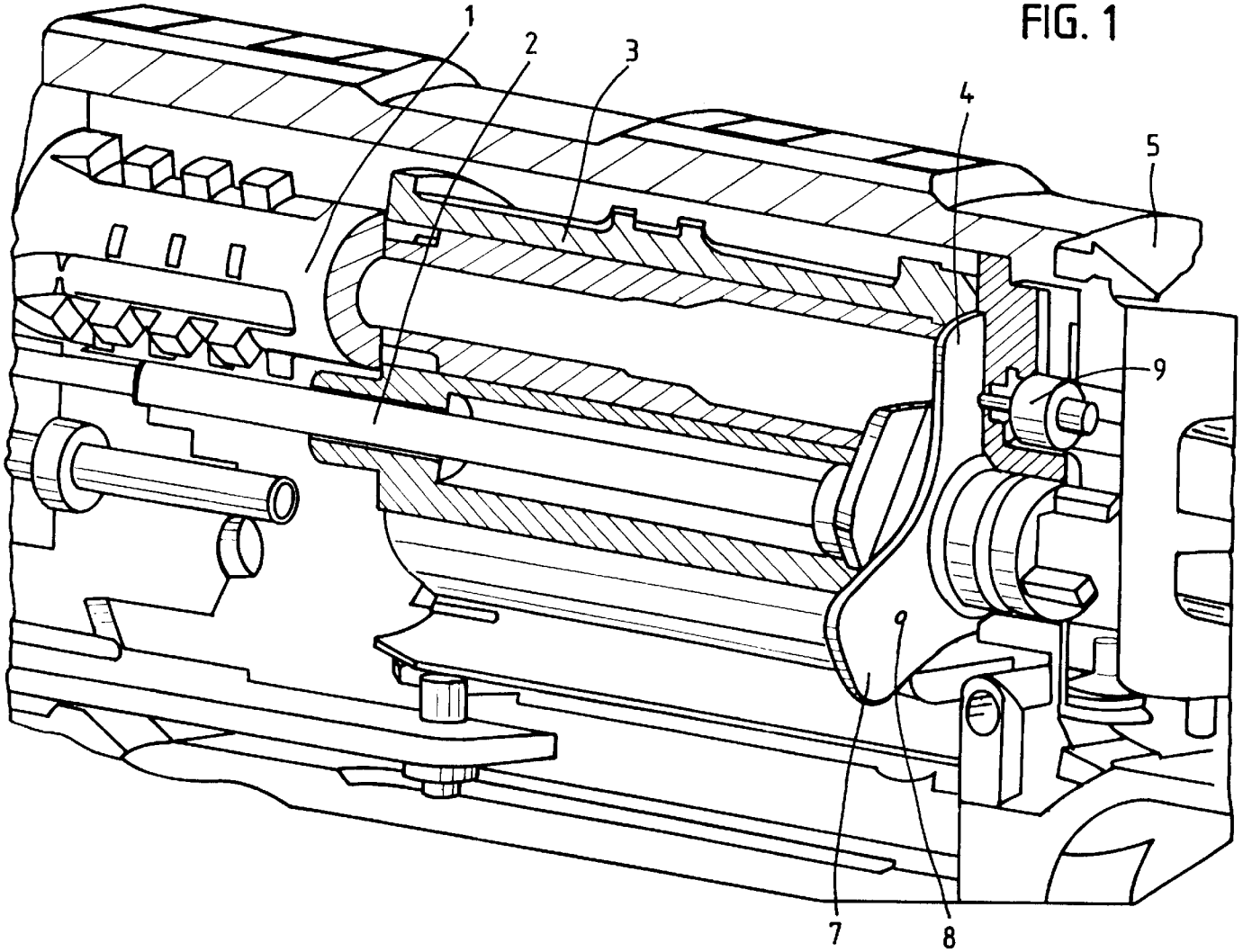
FIG. 1 is a schematic illustration of a section of an exemplary drop barrel revolver constructed in accordance with the teachings of the invention.
Figure 2:
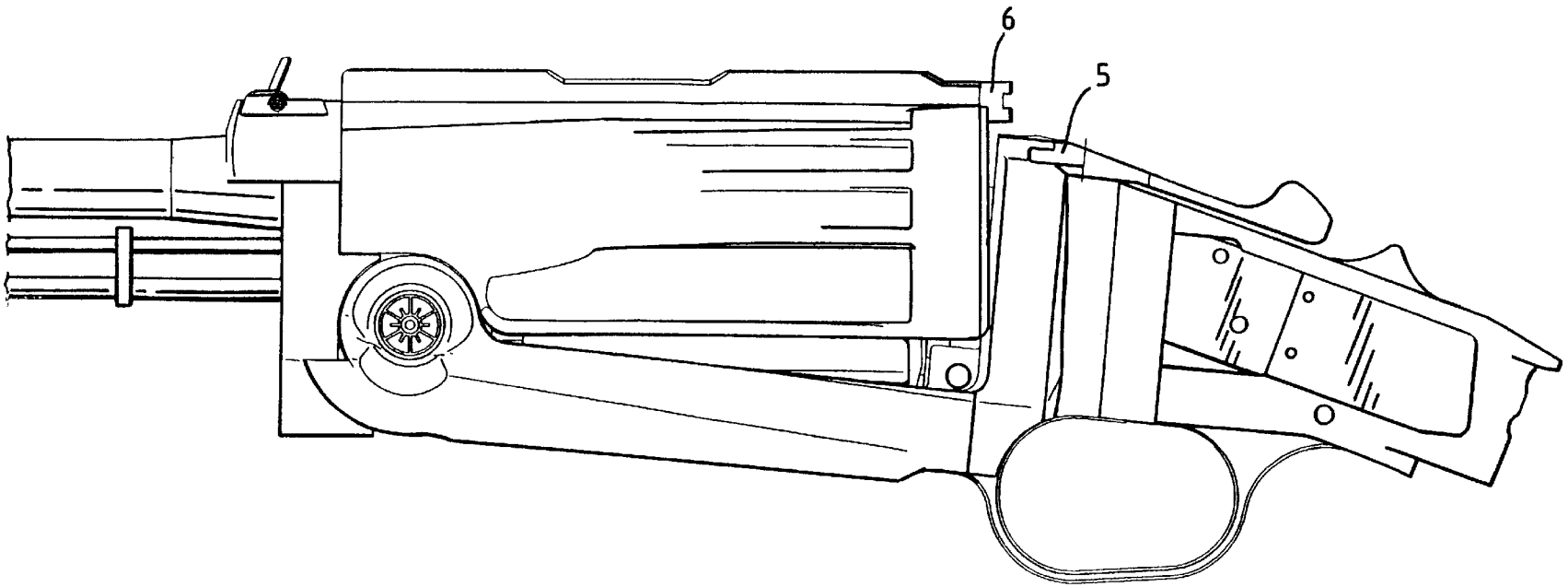
FIG. 2 is an external view of the revolver of FIG. 1 immediately after/before the latch is released/locked to unload/load the weapon.
Figure 3:
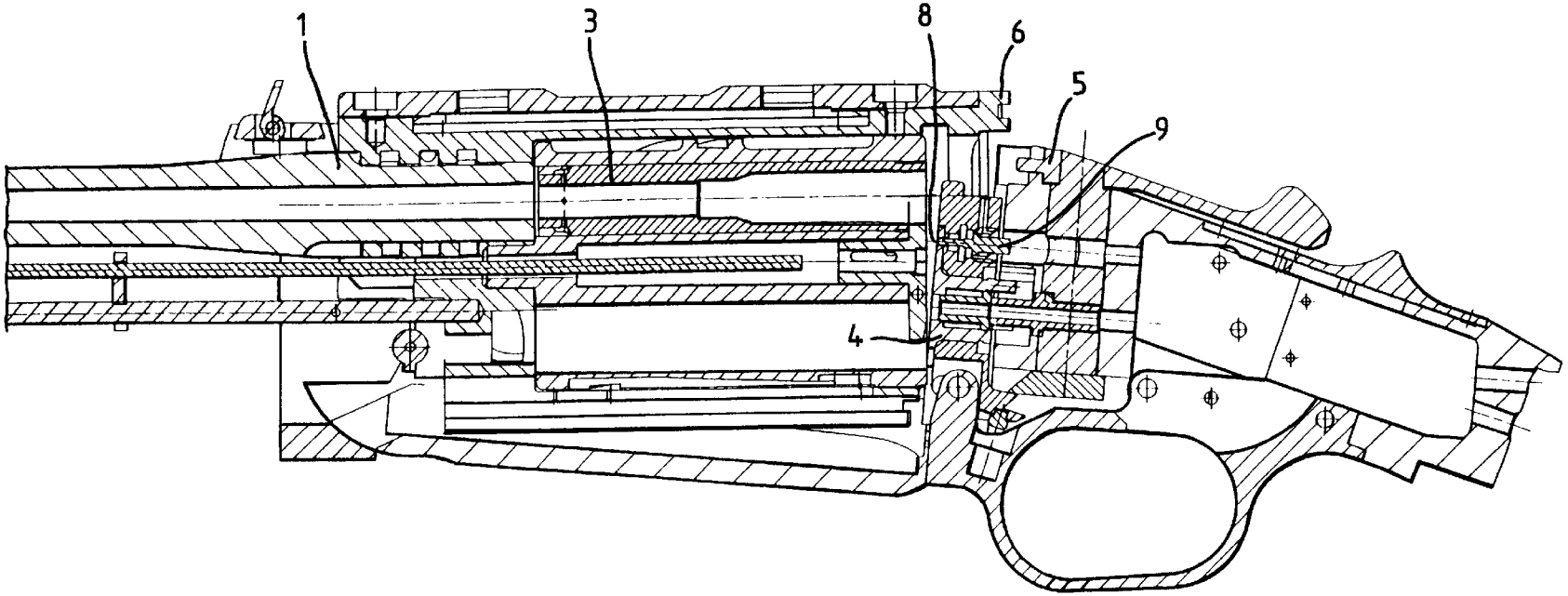
FIG. 3 is a view similar to FIG. 2, but showing the revolver in cross-section.

FIG. 1 shows a section of a drop barrel revolver. The gun includes a gun barrel 1, a cylinder axis 2 parallel to, and positioned underneath, the barrel 1, and a cylinder 3 mounted for pivoting on the cylinder axis 2. The cylinder 3 features several bullet wells. The bullet well currently located behind the barrel 1 is depicted in cross section in FIG. 1.

An impact base plate or recoil plate 4 that pivots about the cylinder axis 2 is arranged behind the cylinder 3. The base plate 4 features three radial lobes or projections 7, each of which covers a corresponding bullet well from behind. A hole 8 for the striking pin 9 is arranged in each projection. Each projection, thus, supports a bullet base from behind in a fully loaded weapon.

The back of the impact base plate 4 is supported by engagement of a rear locking component 5 and a forward locking component 6 (see FIGS. 2–7).

Figure 4:
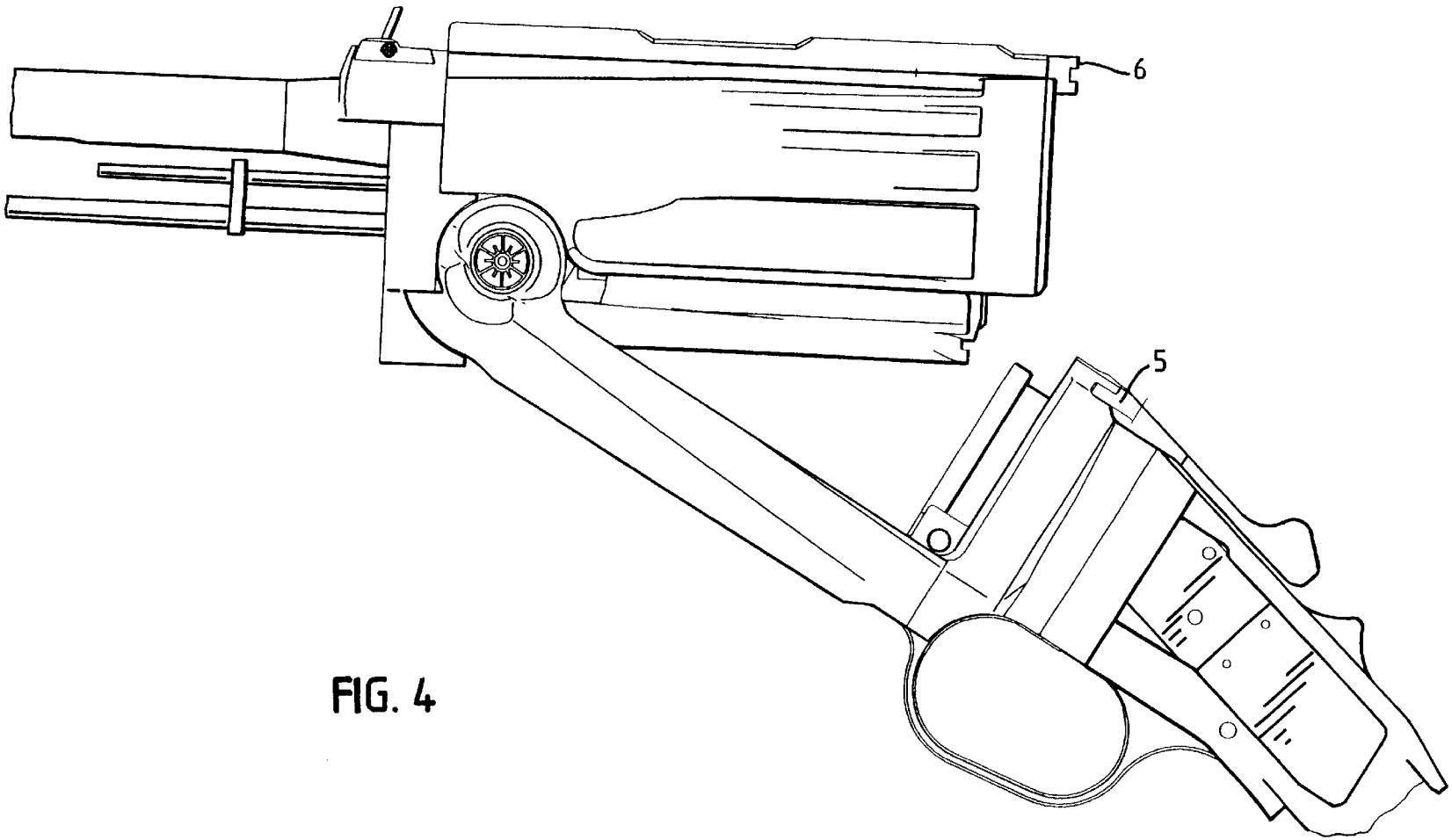
FIG. 4 is a view similar to FIG. 2, but showing the revolver in an opened position for loading/unloading.
Figure 5:
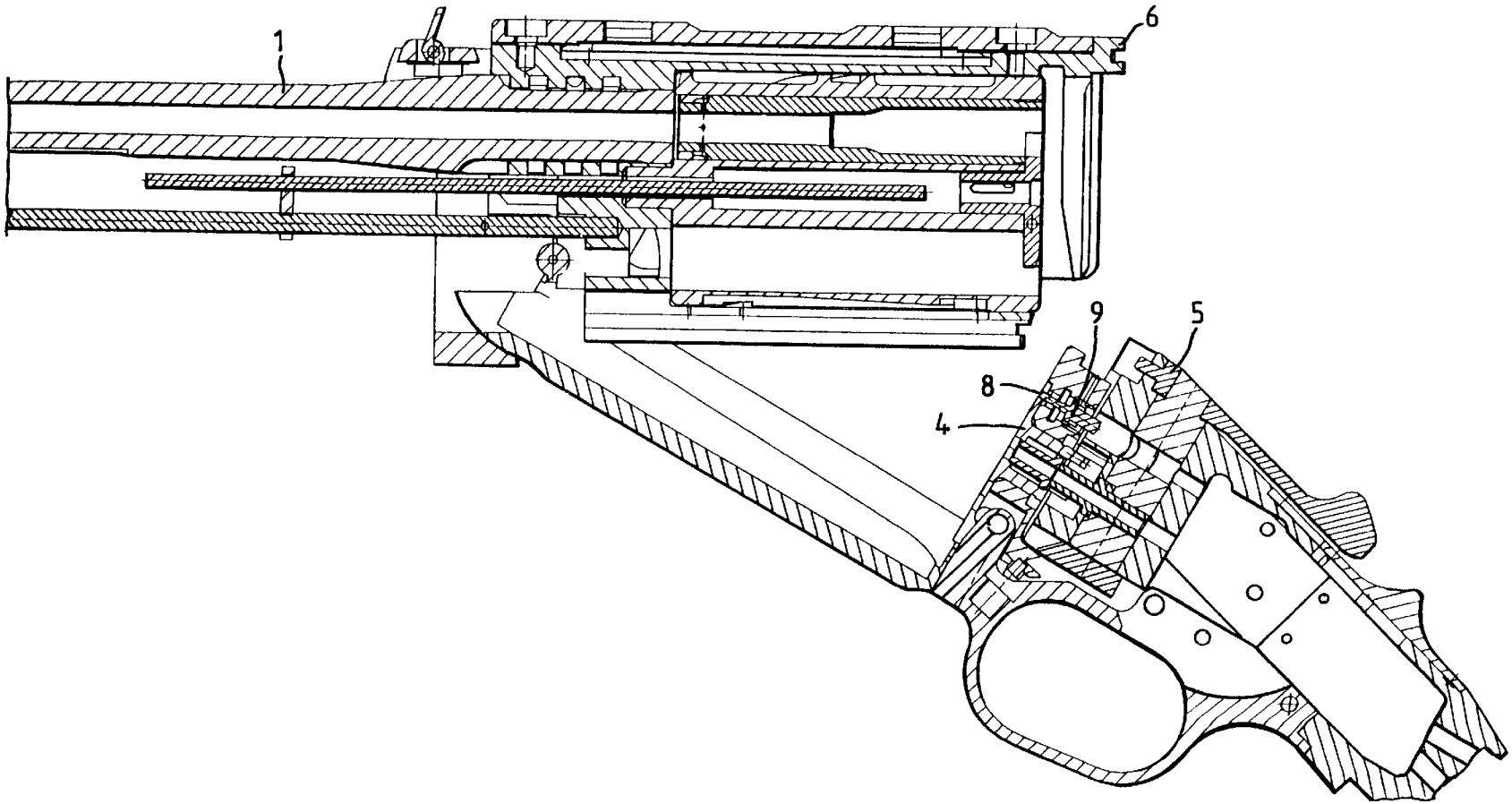
FIG. 5 is a view similar to FIG. 4, but showing the revolver in cross-section.
Figure 6:
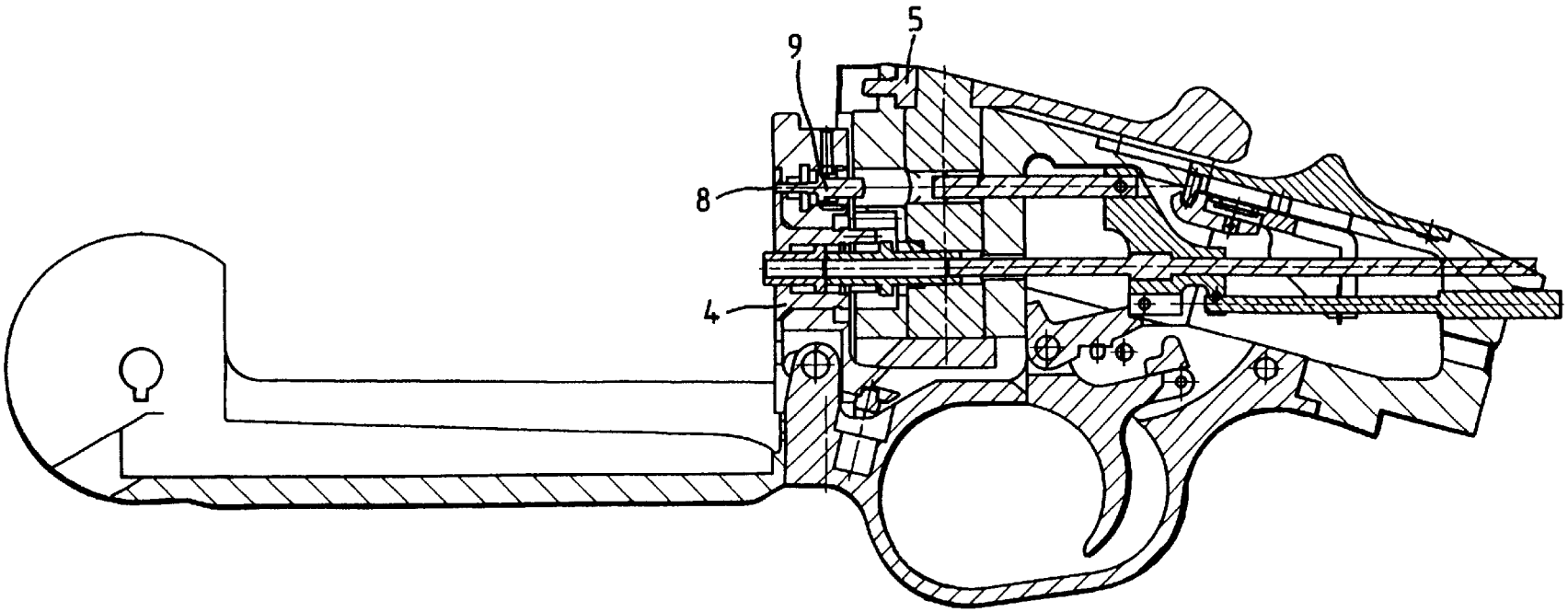
FIG. 6 illustrates the rear portion of the revolver of FIGS. 1–5 in cross-section.
Figure 7:
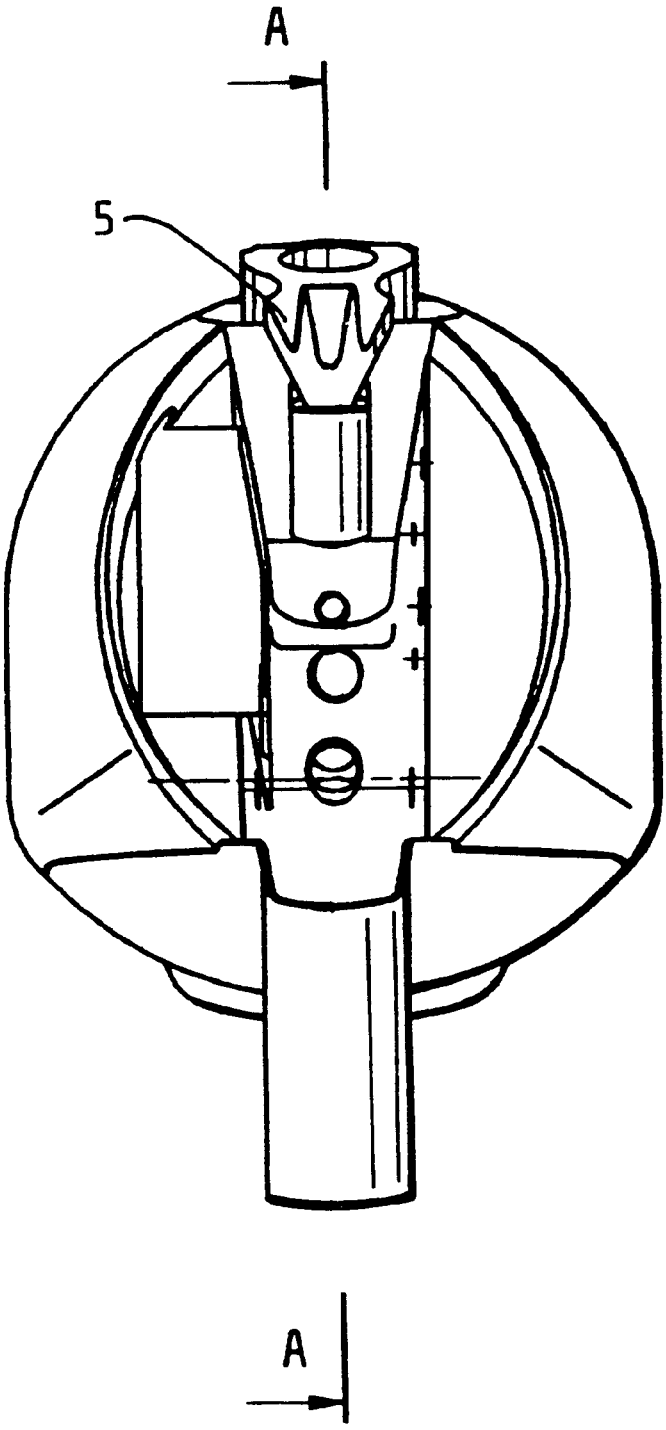
FIG. 7 is a front, cross-sectional view of the revolver showing a portion of the latch in more detail.

When the gun is opened (see FIGS. 2–6), the barrel 1 and the cylinder 3 are tilted away relative to the impact base plate 4 and the rear locking component 5 during which procedure the empty shells located in the bullet wells are pulled out. (A fully opened position is shown in FIGS. 4 and 5.) Once the shells have been removed, new bullets can be introduced. Once the barrel 1 and cylinder 3 have been tilted back up and the locking components 5, 6 are locked into place, the gun is once again ready to be fired.

In the illustrated device, the impact base 4 and the cylinder 3 rotate in synchronicity around the same axis after each shot to locate another bullet in alignment with the barrel. Thus, no matter how severely the impact base 4 and the bullet shell base become jammed together, the ease of motion with which the next shot can take place is not effected, since there is no relative rotational motion between the bullet shell base and the impact base in the weapon (i.e., the impact base 4 rotates with the cylinder 3 and, thus, with the bullet shell base).

To prevent any problems from occurring during unloading, there is no parallel relative motion between the bullet shell bases and the impact base 4. Instead, an almost perpendicular motion occurs between the impact base 4 and the bullet shell base(s) during loading/unloading (see FIG. 3), which virtually rules out any abrasion or jamming.

The well-known drop barrel system is preferred. In this system, both the cylinder 3 and the barrel 1 are tilted downward relative to the impact base 4. The impact base 4 can follow the tilting motion of the barrel 1 and cylinder 3 through a short angular range. Separation of the impact base 4 from the cylinder 3 takes place when, following an initial, joint tilting motion, the seam between these parts 3, 4 is exposed (see FIGS. 2–3). If applicable, it is possible to use a tool to encourage separation of the impact base 4 in the event of shell breakage.

The impact base 4 is preferably made of sheet metal, and contains holes which, when the cylinder 3 and/or the impact base 4 is in the firing position, permit a striker component (e.g., a firing pin) to penetrate one hole in the impact base 4 to discharge the bullet.

The impact base 4 can be formed as a round, flat disk, but to economize on weight, is preferably formed as a substantially flat disk with radial projections in front of each of the bullet wells.

The disclosed device is advantageous when used with any heavy revolver or with a modem revolver gun equipped to fire a powerful hunting bullet. A drop barrel revolver gun whose cylinder is inside a cover (see FIGS. 2, 4 and 7), at least during firing, and, therefore, cannot be gripped with the hand and rotated to support the loading process when operation by means of a gas piston or by hand proves to be difficult is particularly improved by the teachings disclosed herein.

Although certain apparatus constructed in accordance with the teachings of the invention have been described herein, the scope of coverage of this patent is not limed thereto. On the contrary, this patent covers all embodiments of the teachings of the invention fairly falling within the scope of the appended claims either literally or under the doctrine of equivalents.

What is claimed is:

1. For use with a firearm, an assembly comprising:

a cylinder having a longitudinal axis, the cylinder defining a plurality of bullet wells and being structured to rotate around the longitudinal axis in response to a shot; and an impact base positioned behind the cylinder to support bullets within the bullet wells, the impact base being rotatable about the longitudinal axis with the cylinder in response to the shot, wherein the cylinder is tiltable relative to the longitudinal axis, wherein the cylinder is completely covered in a firing position.

2. An assembly as defined in claim 1, wherein the impact base is a plate.

3. An assembly as defined in claim 1, wherein the impact base includes radial projections, each of the radial projections being arranged behind a respective one of the bullet wells of the cylinder.

4. An assembly as defined in claim 3, wherein each of the projections defines a bore sized to receive a firing pin.

5. For use with a firearm, an assembly comprising:

a cylinder having a longitudinal axis, the cylinder defining a plurality of bullet wells and being structured to rotate around the longitudinal axis in response to a shot; and an impact base positioned behind the cylinder to support bullets within the bullet wells, the impact base being rotatable about the longitudinal axis with the cylinder in response to the shot, wherein the cylinder is tiltable relative to the longitudinal axis, wherein the cylinder cannot be engaged from outside the firearm when the cylinder is in a firing position.

6. An assembly as defined in claim 1, wherein the impact base is downwardly tiltable relative to the longitudinal axis through a first degree of motion, the cylinder is downwardly tiltable relative to the longitudinal axis through a second degree of motion, and the second degree is larger than the first degree.

7. A firearm comprising:

a housing;

a cylinder mounted within the housing and having a longitudinal axis, the cylinder defining a plurality of bullet wells and being structured to rotate around the longitudinal axis in response to a shot; and an impact base positioned behind the cylinder to support bullets within the bullet wells, the impact base being rotatable about the longitudinal axis with the cylinder in response to the shot, wherein the cylinder is tiltable relative to the longitudinal axis, wherein the cylinder is completely covered by the housing in a firing position.

8. A firearm as defined in claim 7, wherein the impact base is a plate.

9. A firearm as defined in claim 7, wherein the impact base includes radial projections, each of the radial projections being arranged behind a respective one of the bullet wells of the cylinder.

10. A firearm as defined in claim 9, wherein each of the projections defines a bore sized to receive a firing pin.

11. A firearm comprising:

a housing;

a cylinder mounted within the housing and having a longitudinal axis, the cylinder defining a plurality of bullet wells and being structured to rotate around the longitudinal axis in response to a shot; and an impact base positioned behind the cylinder to support bullets within the bullet wells, the impact base being rotatable about the longitudinal axis with the cylinder in response to the shot, wherein the cylinder is tiltable relative to the longitudinal axis, wherein the cylinder cannot be engaged from outside the firearm when the cylinder is in a firing position.

12. A firearm as defined in claim 7, wherein the impact base is downwardly tiltable relative to the longitudinal axis through a first degree of motion, the cylinder is downwardly tiltable relative to the longitudinal axis through a second degree of motion, and the second degree is larger than the first degree.

* * * * *